US006955065B2

(12) United States Patent
Taylor et al.

(10) Patent No.: US 6,955,065 B2
(45) Date of Patent: Oct. 18, 2005

(54) AIR CONDITIONING SYSTEM

(76) Inventors: Darrell Thomas Taylor, 2128 Albans Rd., Houston, TX (US) 77005; Jeffrey Edward Cantrell, 13315 Golden Valley Dr., Cypress, TX (US) 77429

( * ) Notice: Subject to any disclaimer, the term of this patent is extended or adjusted under 35 U.S.C. 154(b) by 0 days.

(21) Appl. No.: 10/461,239

(22) Filed: Jun. 13, 2003

(65) Prior Publication Data

US 2004/0069001 A1 Apr. 15, 2004

Related U.S. Application Data

(60) Provisional application No. 60/461,482, filed on Apr. 9, 2003, and provisional application No. 60/400,157, filed on Aug. 1, 2002.

(51) Int. Cl.[7] ..... F25B 43/00; F25B 27/00; F25B 13/00

(52) U.S. Cl. ..... 62/474; 62/238.6; 62/324.5

(58) Field of Search ..... 62/474, 324.5, 62/238.6; 237/2 R

(56) References Cited

U.S. PATENT DOCUMENTS

| | | | | |
|---|---|---|---|---|
| 3,498,072 A | | 3/1970 | Stiefel et al. | |
| 4,019,338 A | | 4/1977 | Poteet | |
| 4,232,529 A | | 11/1980 | Babbitt et al. | |
| 4,238,933 A | | 12/1980 | Coombs | |
| 4,279,128 A | | 7/1981 | Leniger | |
| 4,363,218 A | * | 12/1982 | Nussbaum | 62/79 |
| 4,667,479 A | * | 5/1987 | Doctor | 62/93 |
| 5,184,472 A | | 2/1993 | Guilbault et al. | |
| 5,443,112 A | | 8/1995 | Scheideman | |
| 5,471,851 A | | 12/1995 | Zakryk | |
| 5,560,216 A | | 10/1996 | Holmes | |
| 5,560,222 A | | 10/1996 | Perron | |
| 5,613,372 A | * | 3/1997 | Beal et al. | 62/434 |
| 5,701,748 A | | 12/1997 | Phelps et al. | |
| 5,778,696 A | | 7/1998 | Conner | |
| 5,802,864 A | | 9/1998 | Yarbrough et al. | |
| 5,809,796 A | | 9/1998 | Zakryk | |
| 5,901,563 A | | 5/1999 | Yarbrough et al. | |
| 5,906,104 A | | 5/1999 | Schwartz et al. | |
| 5,911,745 A | | 6/1999 | Conner | |
| 5,974,822 A | | 11/1999 | Kopko | |
| 6,109,050 A | | 8/2000 | Zakryk | |
| 6,138,919 A | | 10/2000 | Cooper et al. | |
| 6,145,139 A | | 11/2000 | Bonn | |
| 6,167,715 B1 | | 1/2001 | Hebert | |
| 6,213,405 B1 | | 4/2001 | Spiegel | |
| 6,253,564 B1 | | 7/2001 | Yarbrough et al. | |
| 6,408,633 B1 | | 6/2002 | Carr | |

OTHER PUBLICATIONS

Kjalgaard, Michael J., Engineering Weather Data, 2001,pp. 1, 2, 21, 474–475, McGraw–Hill, U.S.A.

* cited by examiner

*Primary Examiner*—Cheryl Tyler
*Assistant Examiner*—Filip Zec
(74) *Attorney, Agent, or Firm*—Douglas W. Miller

(57) ABSTRACT

A first, optional second, optional third air conditioning systems employing air condensers and/or water condensers, coupled to a water source are disclosed. The water source includes a water to air heat exchanger, which is not coupled to nor provides cooling to either a habitable interior space or an attic.

14 Claims, 2 Drawing Sheets

AIR CONDITIONING SYSTEM

This application claims the benefit of U.S. Provisional Applications No. 60/400,157, filed Aug. 1, 2002 and Ser. No. 60/461,482 filed Apr. 9, 2003. Such benefit is provided under 37 CFR § 1.78 (a)(3) and 35 USC § 120.

TECHNICAL FIELD

Embodiments of the present invention are generally related to air conditioning of one or more interior spaces and cooling or heating a water source or sources in an exterior environment.

BACKGROUND

Systems for cooling interior air spaces using combinations of conventional air conditioners and swimming pools in combination are known. However, the known systems do not include apparatus and methods for cooling or heating the pools, while simultaneously cooling the refrigerant, most especially for performing such operations in locales that are generally unsuitable for evaporative cooling of interior spaces.

U.S. Pat. No. 5,901,563 suggests a heat transfer system for use in cooling and dehumidifying an interior space while rejecting heat to several alternative sources. The system incorporates three primary heat transfer coils in a mechanical refrigeration cycle to provide comfort cooling to an interior space while rejecting heat to one of two primary condensing mediums. The heat transfer system is said to function by transferring heat from the atmosphere to a pool. There is no means disclosed to cool the pool water.

U.S. Pat. No. 5,778,696 suggest a method and apparatus for using various components as a system for cooling air. The apparatus uses a combination of an evaporative cooler, a refrigerated air system with a water cooled condenser, a swimming pool pump, and a swimming pool or other bulk water storage container. During cooler weather, the output air from the evaporative cooler is supplied to a series of ducts and is used to cool the interior of a structure. When the outside ambient temperature and/or humidity exceed the capabilities of the evaporative cooler for cooling the interior of the structure to the desired temperature, the output air from the evaporative cooler is re-directed to the attic space of the structure and the refrigerated air from the refrigerated air system is used to cool the interior of the structure.

Air conditioning systems find wide use, however evaporative cooling systems, once popular in areas of generally low humidity, are being replaced by conventional air conditioning systems in many areas where evaporative cooling and the necessary low humidity were formerly predominant. Not only do evaporative coolers lose efficiency as temperatures and humidities rise, but the air that evaporative coolers supply is generally too humid itself to provide adequate cooling in today's conditioned air market.

In many geographic areas, moving the date of pool use earlier into in the spring and/or later in the fall would be advantageous. Allowing the heat generated in the cooling of a refrigerant circuit to be used in heating a pool, to achieve such expanded pool use would be advantageous. However, as the cooling season progresses and the months get hotter, a method for cooling the pool water while still providing at least some refrigerant cooling would also be advantageous when the pool temperature rises above a temperature generally deemed too high for swimmers to tolerate. In areas where evaporative cooling is not generally practical, such as generally more humid areas, other means would be desirable to cool interior spaces, cool or heat a body of water such as a pool, and improve efficiency of air conditioning systems. There is a commercial need therefore for such a system.

SUMMARY

Among embodiments of our invention are at least one apparatus for cooling the ambient air in a first and a second, or third, fourth, fifth, sixth, seventh, eighth, ninth, tenth, eleventh, twelfth, thirteenth, fourteenth, fifteenth, sixteenth interior space In the case of a first interior space the apparatus comprising: a first air conditioning system, comprising: a first compressor, a first evaporator, a first water cooled condenser, and a first air cooled condenser, each in communication through a first refrigerant conduit; a first air handler comprising the first evaporator, a first fan for moving air past the first evaporator, a first supply and return air duct system, communicating with the first fan and the first evaporator; a first thermostat for controlling operation of the first air conditioning system, the first thermostat communicating with solenoid valve SV2 and a water pump in a pool, the first compressor, the first fan, a second fan for moving air past the first air cooled condenser; a second air conditioning system comprising: a second compressor, a second evaporator, and a second water cooled condenser, each in communication through a second refrigeration conduit; a second air handler comprising the second evaporator, a third fan for moving air past the second evaporator, a second supply and return air duct system communicating with the first fan and the first evaporator; a first thermostat for controlling operation of the first air conditioning system, the first thermostat communicating with solenoid valve SV2 and a water pump in a pool, the first compressor, the first fan, a second fan for moving air past the first air cooled condenser; a second air conditioning system comprising: a second compressor, a second evaporator, and a second water cooled condenser, each in communication through a second refrigeration conduit; a second air handler comprising the second evaporator, a third fan for moving air past the second evaporator, a second supply and return air duct system communicating with the third fan and the second evaporator; a second thermostat for controlling operation of the second air conditioning system, the second thermostat communicating with solenoid valve SV1, the water pump in the pool, the second compressor and the third fan; a water system, comprising: the pool; the first and the second water cooled condensers; the water pump; the valves SV1, SV2 and solenoid valve SV4; a solenoid valve SV3 controlling at least one spray device; each communicating through a water conduit, a spray device in communication with the water circuit via gravity; and wherein the at least one spray device is substantially free of communication with any interior space.

An additional embodiment contemplated includes an apparatus for cooling the interior air in a structure, the apparatus comprising: a water source; an air supply ductwork system; a refrigerated air-conditioning system comprising, a first compressor means, a first water cooled condenser and a first air cooled condenser, a means for moving air past said first air cooled condenser, a first evaporator, a means for moving air past the first evaporator, the water cooled condenser coupled to the water source and to the refrigerant air conditioning system; and the refrigerated air-conditioning system coupled to the air supply ductwork by said first evaporator, and the means for moving air past the evaporator, the first compressor means, the first water cooled condenser, the first air cooled condenser and the first evaporator coupled via a refrigerant conduit; a water to air heat exchanger coupled to the water source, the water to air heat exchanger being substantially free of coupling to the air supply ductwork; and wherein the water to air heat exchanger discharges output air to exterior air; and output water from said water to air heat exchanger is discharged to the water source and the refrigerated air-conditioning system discharges output air through the air supply duct work to the structure.

Also contemplated is a heat transfer system, comprising: a first refrigerant circuit, comprising: a first control means coupled to: a first compressor means, a first refrigerant to air heat exchanger; a second refrigerant to air heat exchanger; a first and a second air circulating means communicating with the first and the second refrigerant heat exchangers respectively, and a first refrigerant to water heat exchanger coupled to the first compressor means each communicating via a refrigerant conduit; a water circuit, comprising: a second control means coupled to: a water circulating means; a water source; the first refrigerant to water heat exchanger; a water to air heat exchanger; and a plurality of valves; wherein the water circuit is coupled to the first refrigerant circuit through the first refrigerant to water heat exchanger; wherein the water to air heat exchanger is substantially free of coupling to an interior space.

A heat transfer system comprising: a first air conditioning system, comprising: a first refrigerant compressor, a first water condenser, a first evaporator and a first evaporator fan; a first air condenser and first air condenser fan; each of the first refrigerant compressor first water condenser, first evaporator and first air condenser in fluid communication via a first refrigerant circuit; a water circuit comprising a water source, the first water condenser, a plurality of valves, a water circulating means and at least one spray means; the first air conditioning system further comprising a first control means coupled to the first refrigerant compressor, the first evaporator fan, the first air condenser fan and at least a first of the plurality of the valves; the water circuit further comprising a second control means coupled to the water circulating means and at least a second of the plurality of the valves; and the at least one spray means substantially free of communication with an interior space.

DESCRIPTION

Figure 1:
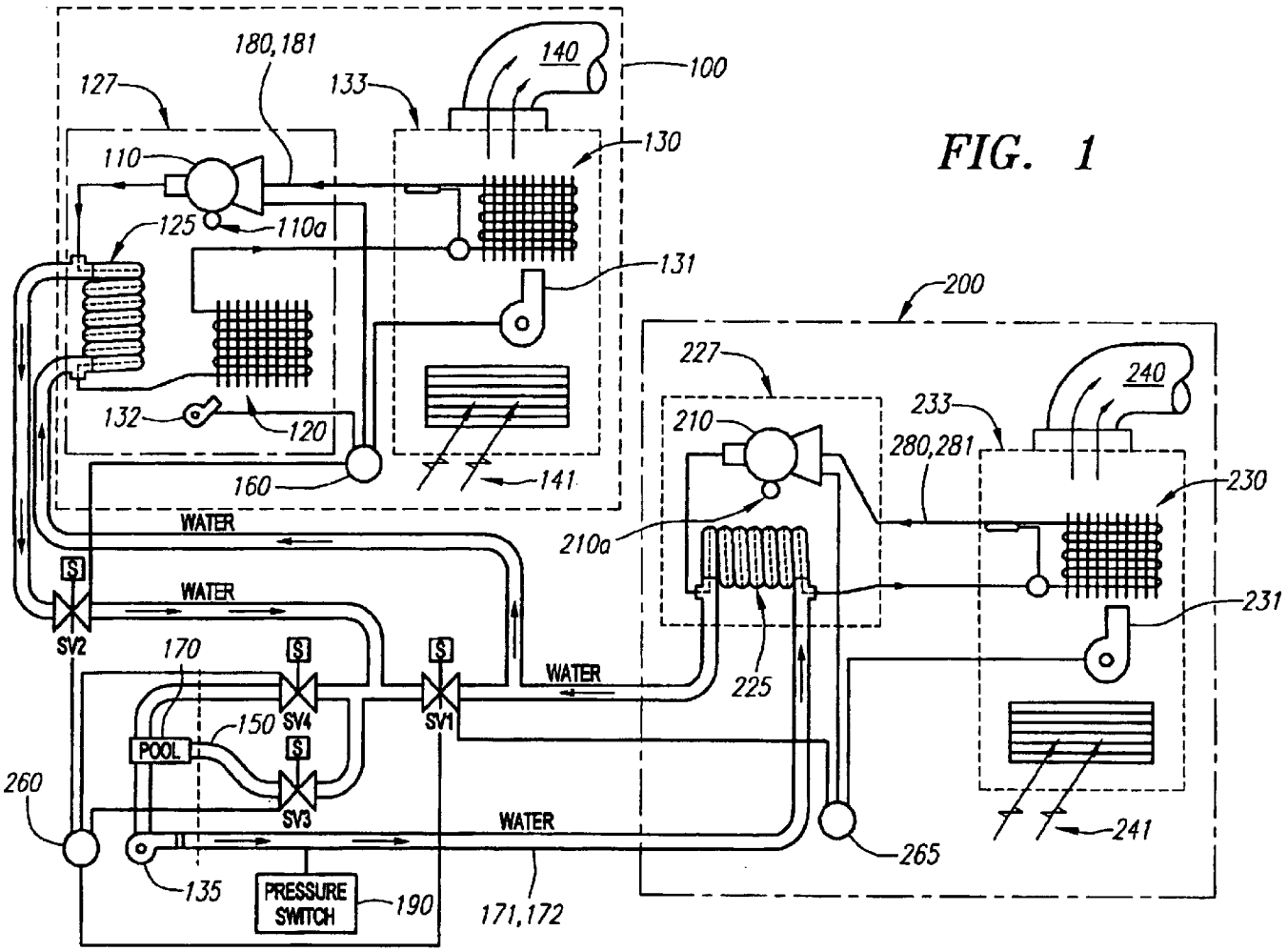
FIG. 1 is a representative schematic showing a first and an optional second air conditioning systems and a water circuit in communication with each of the first and the optional second air conditioning systems.
Figure 2:
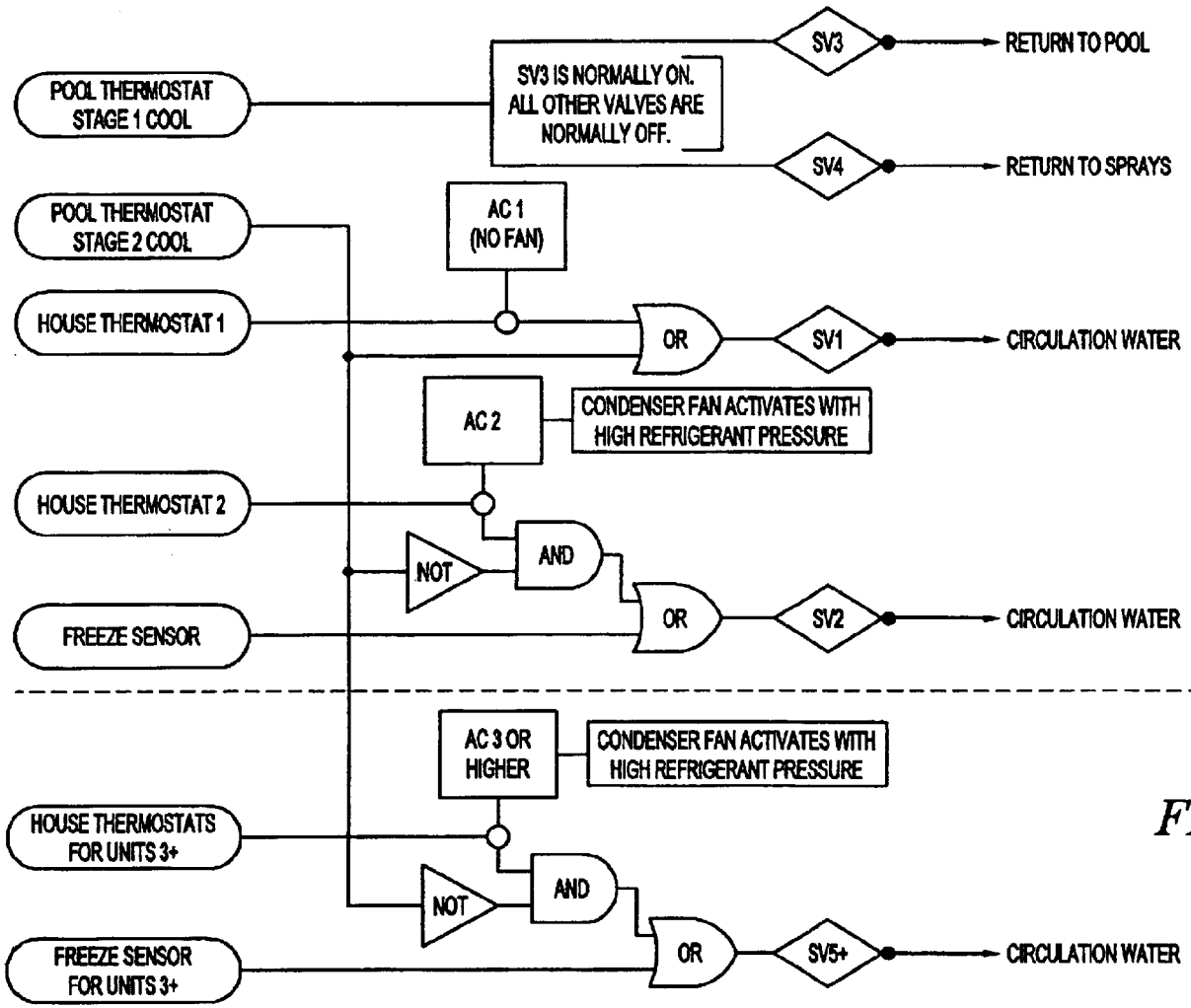
FIG. 2 is a logic diagram showing operation of a first and second air conditioning system and a water circuit.

The air conditioning systems of embodiments of our invention discussed herein are intended for use generally in locales where evaporative coolers would be unsuitable. When the difference between Tdb and Twb is <20° F., or <15° F., or <10° F., evaporative coolers are generally not effective and in embodiments of our invention such differences will be excluded from areas or climates where embodiments of the present invention operate.

Definitions:

Definitions:

Dry Bulb Temperature (Tdb): temperature of air as sensed by a dry thermometer.

Wet Bulb Temperature (Twb): temperature of air if cooled at constant pressure by evaporation of moisture into it, to 100 percent RH.

Interior Space Temperature (TIS) ordinary temperature of an interior space, measured in any conventional way, such as a thermometer, thermostat or other control means.

Water source temperatures (Tws): temperature determined by at least one temperature sensing device in the at least one water source.

Air conditioning system: generally also includes the terms heat transfer system.

Interior space: generally spaces considered heated or cooled habitable and optimally insulated.

Exterior environment: generally ambient air, contrasted to an interior space, especially contrasted to a habitable interior space.

Attic: generally a space not cooled or heated by output of conventional air conditioning systems. While attics are said to be insulated, such terminology usually refers to one or more interior spaces which are insulated, the insulation generally spaced between the attic and one or more interior spaces. Additionally attics are not considered habitable spaces. Attics converted to habitable space will generally be included in an interior space as defined herein.

Interior space: any space inside the outer shell of a building, including attics.

Habitable interior space: a space in a building intended and equipped to be occupied by humans.

Temperatures

A definition of comfort level (for swimming or bathing) relating to a swimming pool water temperature will assist in the understanding of control of elements of embodiments of our invention. Water source (in an embodiment of our invention one or more swimming pools) temperatures, Tws, of ≦85° F., are generally considered too cool for such activities, and Tws ≧90° F. are generally considered too warm for these activities, but differences in personal preferences lead to a description of a comfort zone defined by a lower and an upper temperature set as set points for each operator/user of a system, comprising at least a first 100 and optionally at least a second 200 air conditioning system, including a water circuit 172. The comfort zone is defined between two such set points and will be referred to as a temperature effective for swimming. Or a temperature above or below that effective for swimming will be referred to as a temperature outside that effective for swimming. However, we also contemplate a body or bodies of water that are either not considered for swimming or are large enough to absorb large amounts of heat without substantially altering the overall temperature of a body of water, such as ponds, lakes, oceans, canals, or bays.

As discussed immediately above, a swimming comfort zone of ≧85° F. or ≦90° F. may be expanded or contracted to suit individual requirements, thereby defining a comfort zone for an individual.

In alternate embodiments of our invention, the air conditioning systems described in herein may operate at wet bulb temperatures, Twb, (for an exterior environment) ≧65° F., or ≧66° F., or ≧67° F., or ≧68° F., or ≧69° F., ≧70° F., or ≧71° F., or ≧72° F., or ≧73° F., or ≧74° F., or ≧75° F., or ≧76° F., or ≧77° F., and dry bulb temperatures, Tdb, (for an exterior environment), ≧10° F. or ≧11° F., or ≧12° F., or ≧13° F., or ≧14° F. or ≧15° F. greater than the wet bulb temperature. For instance, if the Twb is 66° F. the Tdb may be 76° F., or 77° F., or 78° F., 79° F., or 80° F., or 81° F.

In alternate embodiments of our invention, the air conditioning system or systems described here in may operate in climates where the following conditions exist:

TABLE I

| ° F. | ≧[b] | or ≧[b] | or ≧[b] | or ≧[b] | or ≧[b] |
|---|---|---|---|---|---|
| 67[a] | 1600 | 1700 | 1800 | 1900 | |
| 68[a] | 1400 | 1500 | 1550 | 1600 | |
| 69[a] | 1100 | 1200 | 1300 | 1400 | |
| 70[a] | 600 | 700 | 800 | 900 | |
| 71[a] | 450 | 500 | 550 | 600 | |
| 72[a] | 80 | 85 | 90 | 95 | |
| 73[a] | 10 | 15 | 20 | 25 | |

[a]wet bulb temperature
[b]number of hours per year that such wet bulb temperature is reached.

Temperatures for all interior habitable, optionally insulated, spaces will be set and determined by each control means set individually or jointly by an operator of the air conditioning systems. Such control means may be a thermostat(s), computing means, and may utilize the internet for communicating such controlling.

First Air Conditioning System

At least a first air conditioning system 100 for cooling a first interior space, comprises:

- a first refrigerant compressor means 110 in fluid communication, through a refrigerant circuit 180, comprising a refrigerant conduit 181, with:
- a first refrigerant to water heat exchanger (first water condenser) 125;
- a first refrigerant to air heat exchanger (first evaporator) 130; and
- a second refrigerant to air heat exchanger (air condenser) 120.

The first air conditioning system 100 further comprising an optional refrigerant storage means such as a tank or reservoir 110*a*, each of these elements in fluid communication via the refrigerant conduit 181.

An air handling unit or air supply circuit in the first interior space to supply cooled and/or dehumidified air to the first interior space, comprising a first 131 means for moving air past the refrigerant conduit in the first (evaporator) 130 (refrigerant to air heat exchanger), in the case of the first evaporator 130 to cool the first interior space; and a first supply 140 and a first return 141 air duct work circuit, operating in the first interior space, the duct work circuit including first supply 140 and first return 141 in communication with the first means 131 for moving air past the refrigerant conduit in the first 130 refrigerant to air heat exchanger (evaporator). The second air circulating means 132 in fluid communication with the second refrigerant to air heat exchanger 120 (air condenser) and exterior ambient air to cool refrigerant.

The first refrigerant compressor means 110 may be any type of compressor such as reciprocating, rotary, scroll, or screw, and is powered by any conventional power source and may be sized over any conventional use range, for instance 1, 2, 3, 4, 5, 6, 7, or 8 ton (12,000 to 96,000 BTU). Also contemplated are halfton increments in the size of compressor, such as 1.5, 2.5, 3.5, 4.5, 5.5, 6.5, 7.5 or 8.5 ton. Such cooling capacity is also contemplated for any of the air conditioning systems disclosed herein, when there is more than one system operating the systems can be the same size or different. They may also be controlled separately or together. More than one compressor can be allocated to cooling a given interior space.

The second refrigerant to air heat exchanger (air condenser) 120, the first refrigerant to water heat exchanger (first water condenser) 125 and compressor means 110 together are the "condensing unit", 127 for the refrigerant in system 100. The condensing units function to condense the refrigerant vapor to a liquid. This is accomplished by compressing the refrigerant and cooling it until it liquefies. Compressor means 110 increases the pressure of the refrigerant vapor and the water flowing through condenser(s) 125 and/or air flowing through/around condenser 120 removes the heat from the refrigerant vapor to condense the refrigerant to a liquid. Condenser 120 may comprise a fin and tube heat exchanger, or tube and tube, or shell and tube heat exchanger, wherein refrigerant flows through the refrigerant conduit 181, and includes an air circulating means or fan 132 for forcing ambient air across the coil in the refrigerant conduit which makes up the air condenser.

First water condenser 125 comprises a water-cooled condenser that provides heat transfer capabilities for system 100. First water condenser 125 presents an effective surface area to remove the heat from the refrigerant (such refrigerant may generically be known as "Freon®", but includes any such refrigerants, both the chlorofluorocarbons and their replacements) that flows through first water condenser 125. The first water condenser 125 may be a helically wound water conduit having a helically wound refrigerant conduit axially disposed therein. Alternatively the first water condenser can be any heat exchanger configuration, such as those described above, that removes heat from the refrigerant and transfers the heat to the water.

The first refrigerant to air heat exchanger (first evaporator) 130, may comprise a fin and tube heat transfer coil located in a first air handling unit, generally referenced as 133. Alternatively the first refrigerant to air heat exchanger 130 may be any heat exchanger to remove heat from air transferring the heat to the refrigerant such as tube in tube or shell a tube heat exchangers. Heat exchanger (evaporator) 130 may comprise a refrigerant input and output. Evaporator coil output is in fluid communication with compressor means 110 via refrigerant conduit 181.

Water Circuit

A water source 170 in fluid communication through a water circuit 172 comprising a water conduit 171, with the first water condenser 125, at least one water circulating means 135, at least one second refrigerant to water heat exchanger 225, solenoid valves SV1, SV2, SV3, and SV4, optional pressure switch 190, and at least one water to air heat exchanger 150, each of these elements may be in fluid communication with the others via the water circuit 172, which comprises a water conduit 171.

The at least one water to air heat exchanger 150 may generally be in the water circuit and controlled by a solenoid valve SV3, and the water circuiting means 135 and control means 260 but may generally not be connected to the water source 170 by a conventional conduit, rather gravity or any effective means to return all or part of the water passing through the water or air heat exchanger 150 to the water source 170, but when SV3 is opened and the at least one water to air heat exchanger 150 is operating in response to the water circulating means 135, and SV3, the at least one water to air heat exchanger 150 may still generally be in fluid communication with the water source.

Solenoid valve SV2 spaced between the first refrigerant to water heat exchanger 125 and the water source 170 and operates (opens) when Tws is in or below the comfort zone and the first air conditioning system 100 is operating; in such cases the at least one water circulation means 135 also operates in concert with the first air conditioning system 100 at such temperatures;

Solenoid valve SV4 spaced between SV1, SV2 and the water source; and serves to control water flow to the water source 170 and thereby to the applicable parts of the water circuit 172; SV4 remains open at all times when Tws is at or below the lower limit of the comfort zone;

Solenoid valve SV1 spaced between the second refrigerant to water heat exchanger 225 and water source; and SV1 always opens in response to operation of second air conditioning system 200;

Solenoid valve SV3 and the attendant conduit, represents an additional or alternate path from one or both of first refrigerant to water heat exchanger 125 or second refrigerant to water heat exchanger 225 to the water source 170; and SV3 will open in response to the second control means 260 and the sensed temperature (by control means 260) of the water source 170. When Tws is greater than (exceeds) the comfort zone, SV3 is opened continuously and the water circulation means 135 is operating continuously. SV3 may be also be opened when Tws is in the comfort zone and one or both first (100) and/or second (200) air conditioning systems are operating. In an alternate embodiment, SV4 and SV3 are not in phase, that is when SV4 is open, SV3 is closed, and vice versa.

The optional pressure switch 190 in the water circuit is capable of detecting a pressure drop in the water circuit and when either or both of SV1 and/or SV2 are opened in response to events described herein, the pressure switch 190, activates the water circulation means 135. As for instance if a pressure switch may be set arbitrarily to activate the water circulation mans 135 when the system pressure drops at or below 15 psi and deactivates when system pressure exceeds 30 psi. In this embodiment, when the first (100) and/or second (200) air conditioning systems operate and one or more of SV1–SV4 operate (open), the pressure in the system falls and at ≦15 psi the pressure switch 190 activates the water circulation means 135. When the appropriate air conditioning system or systems cease operation and all valves close, the pump continues building pressure. At ≧30 psi (arbitrary) the pressure switch 190 deactivates the water circulation means 135.

The water source 170 may comprise any water body or bodies or containers with a minimum of 200 US gallons, total contained therein, and may be one or more swimming pools, ponds, municipal water sources, lakes, bays, oceans, canals, reservoirs or combinations thereof. Each water source may serve one or more air conditioning systems or each may serve just one air conditioning system.

Solenoid valves SV3 and SV4 may be combined in a three-way valve accomplishing a similar function as two such valves in combination.

The water conduit may be any means of conveying water, such as pipes, or tubes, or open or closed aqueduct and may be made of any material, such as PVC, copper, cuppernickel, lead, steel, iron, polybutene, polyethylene or the like.

The water circulating means may comprise any conventional means for circulating water such as impeller pumps, gravity or the like.

The at least one water to air heat exchanger 150, may be any conventional such heat exchanger. In one embodiment of our invention, the at least one water to air heat exchanger 150 is one or more of spray devices, one or more evaporative coolers, one or more water slingers, one or more water falls or combinations thereof. The water to air heat exchanger 150 is coupled to the water source generally by gravity, the water to air heat exchanger 150 being substantially free of coupling to either of the air supply ductworks 140 or 240. By substantially free we intend that the water to air heat exchanger 150 supplies no cooling directly to any interior space, either an attic or living space. The function of the at least one water to air heat exchanger 150 is limited directly to cooling the water source, and indirectly to cooling the refrigerant in the first air conditioning system 100 and/or second air conditioning system 200 and/or other additional air conditioning systems that are contemplated. Further, the air output of the heat exchanger 150 is limited to the ambient (exterior) air. Similarly the input air to the heat exchanger 150 is also generally ambient exterior air. That is the output air of heat exchanger 150 is not directed to an interior space and/or attic. The water output of the water to air heat exchanger 150 is generally directed through means of gravity or other such means, back to the water source 140. The at least one water to air heat exchanger may serve additional air conditioning systems, such air conditioning systems may employ a water condenser, an air condenser, or both. In such cases, an additional solenoid valve SVn may be employed between a water condenser of one or more additional air conditioning systems and the water source 170. n is an integer greater than 4, such as 5, 6, 7, 8, 9, 10, 11, 12, 13, 14, 15, or 16. The water to air heat exchanger 150, may generally comprise a method or a means of cooling water. Such methods or means may comprise relatively straight forward means such as one or more spray devices or heads that are positioned to spray the water in droplets or mist, from fine to coarse, into exterior air, whereupon generally the water not evaporated will return to the water source. The water to air heat exchanger may also comprise one or more evaporative coolers, which generally operate by exposing increased surface area of water to air. These means may be combined.

Second Air Conditioning System

Optionally, a second air conditioning system 200, for cooling a second interior space, comprises a second refrigerant compressor means (210) in fluid communication with:

(a) a second refrigerant to water heat exchanger (second water condenser) 225; and (b) a third refrigerant to air heat exchanger (second evaporator) (230).

The optional second air conditioning system also comprises an optional second refrigerant storage means 210*a* such as a tank or reservoir, each of these elements is in fluid communication via a second refrigerant circuit 280, comprising a second refrigerant conduit 281.

An air supply circuit or air handling circuit 233 in the second interior space, comprising a third means 231 for moving air past the refrigerant conduit in the third 230 refrigerant to air heat exchanger (second evaporator), to cool the second interior space; and a second supply 240 and a second return 241 air duct work circuit, operating in the second interior space, the duct work circuit in communication with the third means 231 for moving air past the refrigerant conduit in the second 230 refrigerant to air heat exchanger.

The second refrigerant compressor means 210 and any electrical apparatus discussed herein may be any type of compressor such as reciprocating, rotary, scroll, screw, and is powered by any power source such as a.c., d.c., gas, gasoline powered, fuel cells, diesel powered and may be sized over any conventional use range, for instance 1–8 ton as described above for the first refrigerant compressor 110. The second refrigerant compressor means 210 can be any size 0.5, 1, 1.5, 2, 2.5, 3, 3.5, 4, 4.5, 5, 5.5, 6, 6.5, 7, 7.5, 8 and may be the same or different than the first air conditioning system compressor means or other (n) air conditioning system compressor means.

The second refrigerant to water heat exchanger (second water condenser) 225 and compressor 210 together are the "condensing unit" 227 for the refrigerant in system 130. The condensing unit functions to condense the refrigerant vapor to a liquid.

Second water condenser 225 may be a water-cooled condenser that provides heat transfer capabilities for system 200. Second water condenser 225 presents adequate surface area to remove the heat from the refrigerant (such refrigerant may generically be known as "Freon®", but includes any such refrigerants, both the chlorofluorocarbons and, their replacements) that flows through second water condenser 225. The condenser 225 may be a helically wound water conduit having a helically wound refrigerant conduit axially disposed therein or other heat exchanger design such as fin and tube, shell and tube, tube and tube or combinations thereof.

The second refrigerant to air heat exchanger (second evaporator) 230, may comprise a fin and tube heat transfer coil (or any heat exchanger type as disclosed herein) located in an air handling unit 233, generally referenced as 233. Heat exchanger 230 may comprise a refrigerant input and output. Evaporator 230 output is in fluid communication with compressor means 210 via refrigerant conduit 281. Which compressor means 210 is in fluid communication with second water condenser.

The first and second air conditioning systems generally do not directly communicate. While also generally these two may be two parts of a whole, as for instance an upstairs and a downstairs unit, that under certain air flow and spatial arrangements will communicate through air exchange in common areas, this is considered an indirect communication. The first and second air conditioning systems may also be in communication with one another through (indirectly) sharing a water source.

Control Means

First air conditioning system 100 further comprises a first control 160 means responsive to temperature in the first interior space TIS1 (in response to a call for cooling) controlling the water circulation means 135, controlling first compressor means 110, the air circulation means 132 and 131, controlling SV2 which is open when Tws is in or below the comfort zone and first air conditioning system 100 is operating. At such times that TIS1 exceeds an interior comfort zone, the first control means 160 causes the first compressor means 110, the water circulation means 135, the air circulation means 131 and 132 to operate and SV2 to open.

The first control means and any other control means may be a thermostat or any temperature sensing device with an ability to control elements of the air conditioning systems to provide cooled air to an interior space or any other function described herein.

When Tws is at or above the upper limit of the comfort zone and system 100 operates, a second control means overrides the input of the first control means to SV2 and closes SV2 and the first control means 160 operates the air circulation means 132 exclusively tocool the refrigerant in the first air conditioning system 100.

The second control means 260 responsive to the water source, such that the second control means 260:

at Tws at or about upper limit of the comfort zone, the second control means overrides the input from the first control means and closes SV2 The second control means may also control the water circulation means 135, SV4 and SV3 when the water source temperature is at or above the upper limit for the comfort zone. At such times the second control means causes the water circulation means 135 to operate and SV3 to open, and SV4 to close.

A third control means 265 responsive to a temperature in the second interior space TIS2 controlling the second compressor means 210 and the third air circulating means 231 and solenoid valve SV1 which is always open during operation of the second air conditioning system.

An optional pressure switch 190 in said water circuit, detects pressure drops in the circuit such that when either or both SV1 and/or SV2 are opened, the water circulating means 135 operates in response to 190, unless Tws is at or above the water source comfort zone, in which case SV2 remains closed.

The second control means 260 responds to Tws such that:

Tws is at or below the lower limit of the comfort zone, SV1 and SV2 open in response to the first and/or second air conditioning systems operation, and water circulating means operates; SV3 is not opened, therefore no operation of water to air heat exchanger occurs;

Tws is in the comfort one SV1 SV2 and SV3 open in response to either system operation and water circulating means 135 operates; when either or both air conditioning systems are operational;

Tws is at or above the upper limit of the comfort zone second control means 260 overrides input from first control means 160 to SV2 and SV2 remains closed during operation of first air conditioning system 100, the water circulating means 135 operates continuously, SV1 always opens in response to the second system operation, the second control means causes the water circulating means to operate continuously, SV4 is closed continuously, and SV3 is open continuously, providing cooling to the water source.

In an alternate embodiment, when the first air conditioning system 100 operates in response to call for cooling from first control means 160, and Tws is at or below the lower limit of the comfort zone, the first compressor means operates 110, the first air circulating means 131 operates and, the first evaporator 130 operate to cool the interior space, second air circulating means 132 operates or does not operate to cool refrigerant, depending upon the programming of the system, and the water circulation means 135 operates and SV2 is open.

When the first system 100 operates in response to call for cooling from first control means 160, and Tws is in the comfort zone, the first compressor means operates 110, the first air circulating means 131 and first evaporator 130 operate to cool the interior space, second air circulating means 132 operates to cool the refrigerant in 120 air condenser, the water circulation means 135 operates and SV2 is open and the first water condenser 125 is also operating to cool refrigerant.

When the first system 100 operates in response to call for cooling from first control means 160, and Tws is at or above the upper limit of the comfort zone, the first compressor means operates 110, the first air circulating means 131 and first evaporator 130 operate to cool the interior space, second air circulating means 132 operates to cool the refrigerant, and SV2 is closed and the first water condenser 125 is not employed to cool the refrigerant.

When second air conditioning system 200 operates in response to call for cooling from third control means 265, the second compressor means 210 operates, the third refrigerant to air heat exchanger (evaporator) 230 operates in conjunction with the third air circulating means 231, and the second water condenser 225 is employed to cool the refrigerant. At all times of operation of second air conditioning system 200, SV1 is open, water circulation means 135 isoperating.

The first refrigerant circuit 180 is in fluid communication with the water circuit 171, via the first refrigerant to water heat exchanger 125, which comprises an inner and an outer conduit, one of the inner or outer conduits is the first refrigerant conduit 181, the other the water conduit 171.

Similarly, the second refrigerant circuit 280 is in fluid communication with the water circuit 171, via the second refrigerant to water heat exchanger 225, which also comprises an inner and an outer conduit, one of the inner or outer conduits is the second refrigerant conduit 281, the other is the water conduit 171.

Each of the interior spaces may be controlled by a separate control means, or the same control means and the set points calling for cooling each of the interior spaces can be the same or different.

Modes of Operation

First Air Conditioning System Operating, Second Air Conditioning System Not Operating.

When Tws is at or below the lower limit of the comfort zone and TIS1 exceeds the level set by the inhabitants, the first air conditioning system 100 is operated, including both condensers (120, 125) and air circulating means 132, which may be a fan, the first refrigerant to air heat exchanger 120, evaporator 130 and air circulating means which may be fans 131 and 132 operate, SV2 is opened, water circulating means 135 operates.

When Tws is in the comfort one and TIS1 exceeds the level set by inhabitants, the first air conditioning system 100 is operated, including both condensers (120, 125) and air circulating means 132, evaporator 130 and air circulating means 131 and supply and return air ducts 140 and 141, SV2 is open, SV4 is closed, SV3 is open, water circulating means 135 operates.

When Tws is at or above the upper limit of the comfort zone and TIS1 exceeds the level set by inhabitants, the first air conditioning system is operated, including condenser 120, and air circulating means 132, evaporator 130, and air circulating means 131, and supply and return air ducts (140, 141), SV2 is closed and SV4 is closed, SV3 is open, water circulating means 135 operates continuously (i.e. not in response to refrigeration circuit operation). However with SV2 closed, condenser 125 is denied water from the water source and will play a negligible role in cooling the refrigerant.

Second Air Conditioning System Operating, First Air Conditioning System Not Operating.

When Tws is at or below the lower limit of the comfort zone and TIS2 exceeds the level set by the inhabitants, the second air conditioning system 200 is operated, including the condenser 225, evaporator 230 and air circulating means 231 and supply and return air ducts (241 and 241), SV1 is opened, SV3 and SV2 are closed, water circulating means 135 operates.

When Tws is in the comfort zone and TIS2 exceeds the level set by the inhabitants, the second air conditioning system 200 is operated, including the condenser 225, evaporator 230 and fan 231 and supply and return air ducts (240 and 241), SV1 is open, SV4 is closed, SV3 is open, water circulating means 135 operates.

When Tws is at or above the upper limit of the comfort zone and TIS2 exceeds the level set by inhabitants, the second air conditioning system 200 is operated, including the condenser 225, evaporator 230 and fan 231 and supply and return air ducts (240 and 241), SV1 is open and SV4 is closed, SV3 is open continuously, water circulating means 135 operates continuously (i.e. not in response to refrigeration circuit operation).

Both First and Second Air Conditioning Systems are Operating

When Tws is at or below the lower limit of the comfort zone each air conditioning system 100 and 200 operates in response to the respective interior space temperature and SV2 is open in response to the operation of the first air conditioning system 100 operation, SV1 and SV4 open in response to the operation of the second air conditioning system 200 operation, water circulation means 135 operates in response to either or both air conditioning system 100 and/or 200 operation.

When Tws is in the comfort zone each air conditioning system 100 and/or 200 operates in response to the respective TIS and SV2 and SV3 open in response to the operation of the first air conditioning system 100 operation, SV1 and SV3 open in response to the operation of the second air conditioning system 200 operation, water circulation means 135 operates in response to either or both refrigeration circuits operation.

When Tws is at or above the upper limit of the comfort zone each air conditioning system 100 and/or 200 operates in response to the respective TIS and SV2 remains closed in response to the operation of the first refrigeration circuit operation, SV1 opens in response to the operation of the second refrigeration circuit operation, water circulation means 135 operates continuously. SV3 is open continuously.

Additional Air Conditioning Systems

The cooled air supplied to one or more interior spaces in embodiments of our invention will have a chlorine content equal to or lower than either or both of the existing air in the interior space or fresh makeup air.

Additional air conditioning systems may be employed in addition to the first and/or optional second air conditioning systems. Each additional system may be similar in operation to either the first 100 or second 200 air conditioning systems, and each of the systems may be the same or different in size of compressors. Such additional systems may employ an additional solenoid valve (SVn) for each additional system. There may be 1, or 2, or 3, or 4, or 5, or 6, or 7, or 8, or 9, or 10, or more additional systems in addition to the first (100) and optional second (200) air conditioning systems discussed herein. Each additional system may have all or part of the elements described herein as elements of the first 100 and/or second 200 air conditioning systems. For example, a third air conditioning system may include an air condenser, a water condenser or both. Such a third system and/or any other additional systems, may communicate with a separate water source or the same water source as the first and second air conditioning systems.

TABLE II

| | Logic States: | | | | | | | | | | | | | | |
|---|---|---|---|---|---|---|---|---|---|---|---|---|---|---|---|
| A | B | C | D | E | F | G | H | I | J | K | L | M | N | O | P |
| 1 | — | — | — | — | — | — | — | — | — | — | — | — | — | — | — |
| Logic States With Below Comfort Zone Pool Water (Typically ≦85° F.) | | | | | | | | | | | | | | | |
| 2 | on | — | * | — | — | — | on | — | * | on | — | * | — | — | — |
| 3 | | on | * | — | — | — | — | on | * | — | on | * | — | — | — |
| 4 | on | on | * | — | — | — | on | on | * | on | on | * | % | — | — |
| 5 | * | * | on | — | — | — | * | * | on | * | * | on | — | — | — |
| Logic States With Comfort Zone Pool Water (Typically ≧85 or ≦90° F.) | | | | | | | | | | | | | | | |
| 6 | — | — | — | on | — | — | — | — | — | — | — | — | — | — | — |
| 7 | on | — | * | on | — | — | on | — | * | on | — | * | — | * | on |
| 8 | — | on | * | on | — | — | — | on | * | — | on | * | % | * | on |
| 9 | on | on | * | on | — | — | on | on | * | on | on | * | % | * | on |
| 10 | * | * | on | on | — | — | * | * | on | * | * | on | * | % | on |
| LogicStates With Above Comfort Zone Pool Water (Typically ≧90° F.) | | | | | | | | | | | | | | | |
| 11 | * | * | * | on | on | — | * | * | * | on | * | on | * | * | on |
| Logic With Freezing Air Temperatures (Assumes no demand for concurrent cooling) | | | | | | | | | | | | | | | |
| 12 | — | — | — | — | — | on | — | — | — | — | on | on | — | — | — |

— = Off or not in use.
* = System operations are indifferent to the state of component.
on = This component must be on in this mode.
% = This fan will come on only if the cooling water is removing insufficient heat.
Logic States Components Key
A Logic Case
B Thermostat Unit 1
C Thermostat Unit 2
D Thermostat Unit 3+
E Pool Thermostat Stage 1
F Pool Thermostat Stage 2
G Freeze Sensor
H Air Conditioning Unit 1
I Air Conditioning Unit 2
J Air Conditioning Unit 3+
K Water Valve Unit 1
L Water Valve Unit 2
M Water Valve Unit 3+
N Condenser Fan Unit 2
O Condenser Fan Unit 3+
P Spray Heads Activation

TABLE III

And Gate Logic Table

| Input 1 | Input 2 | Output |
|---|---|---|
| Off | Off | Off |
| Off | On | Off |
| On | Off | Off |
| On | On | On |

TABLE IV

Not Gate Logic Table

| Input | Output |
|---|---|
| On | Off |
| Off | On |

TABLE V

Or Gate Logic Table

| Input 1 | Input 2 | Output |
|---|---|---|
| Off | Off | Off |
| Off | On | On |
| On | Off | On |
| On | On | On |

We claim:

1. An apparatus for cooling the ambient air in a first and/or a second interior space, said apparatus comprising:

a) a first air conditioning system, comprising:

i) a first compressor, a first evaporator, a first water cooled condenser, and a first air cooled condenser, each in communication through a first refrigerant conduit;

ii) a first air handler comprising the first evaporator, a first fan communicating with the first evaporator, a first supply and return air duct system communicating with said first fan and said first evaporator, iii) a first thermostat communicating with solenoid valve SV2 and a water pump, said first compressor, said first fan, a second fan communicating with said first air cooled condenser;

b) a second air conditioning system comprising:
i) a second compressor, a second evaporator, and a second water cooled condenser, each in communication through a second refrigeration conduit;
ii) a second air handler comprising the second evaporator, a third fan communicating with the second evaporator, a second supply and return air duct system communicating with said third fan and said second evaporator,
iii) a second thermostat communicating with solenoid valve SV1, the water pump, said second compressor and said third fan;

c) a water system, comprising:
i) a pool;
ii) said first and said second water cooled condensers;
iii) said water pump;
iv) said valves SV1, SV2 and a solenoid valve SV4;
v) a solenoid valve SV3 controlling at least one spray device;

each of i)–iv) communicating through a water conduit, said spray device in communication with said pool; and wherein said at least one spray device is substantially free of communication with any interior space.

2. The apparatus of claim 1, wherein said apparatus operates in an environment wherein the exterior air comprises a wet bulb temperature (Twb)≧70° F. and a dry bulb temperature (Tdb)≧13° F. greater than said Twb.

3. An apparatus for cooling the interior air in a structure, the apparatus comprising:

a water source;

an air supply ductwork system;

a refrigerated air-conditioning system comprising, a first compressor means, a first water cooled condenser and a first air cooled condenser, a means for moving air past said first air cooled condenser, a first evaporator, a means for moving air past said first evaporator, said water cooled condenser coupled to the water source and to said refrigerant air conditioning system; and said refrigerated air-conditioning system coupled to the air supply ductwork by said first evaporator, and said means for moving air past said evaporator;

said first compressor means, said first water cooled condenser, said first air cooled condenser and said first evaporator coupled via a refrigerant conduit;

a water to air heat exchanger coupled to the water source, said water to air heat exchanger being substantially free of coupling to the air supply ductwork; and wherein the water to air heat exchanger discharges output air to exterior air; and output water from said water to air heat exchanger is discharged to said water source and the rigerated air-conditioning system discharges output air through the air supply duct work to the structure, wherein said apparatus comprises a second air supply duct work system coupled to a second refrigerated air conditioning system said second refrigerated air conditioning system coupled to a second water cooled condenser, coupled to the water source; said second refrigerant air conditioning system comprises a second compressor means, a second evaporator, each of said compressor means, said second evaporator, said second water cooled condenser communicating through a refrigerant conduit.

4. The apparatus of claim 3, wherein said exterior air comprises a wet bulb temperature (Twb) of ≧650° F., and a dry bulb temperature (Tdb)≧10° F. greater than said Twb.

5. The apparatus of claim 3, wherein said exterior air comprises Twb of ≧70° F. and Tdb≧12° F. greater than said Twb.

6. A heat transfer system, comprising:

a) a first refrigerant circuit, comprising:
i. a first control means coupled to:
ii. a first compressor means;
iii. a first refrigerant to air heat exchanger;
iv. a second refrigerant to air heat exchanger;
v. a first and a second air circulating means communicating with said first and said second refrigerant to air heat exchangers respectively;
vi. a first refrigerant to water heat exchanger coupled to said first compressor means; ii.–vi. communicating via refrigerant conduit;

b) a water circuit, comprising:
i. a second control means coupled to:
ii. a water circulating means;
iii. a water source;
iv. a water to air heat exchanger;
v. a plurality of valves; and
vi. said water circuit further comprising said first refrigerant to water heat exchanger; said i.–vi. communicating via a water conduit;

wherein said water circuit is coupled to said first refrigerant circuit through said first refrigerant to water heat exchanger;

wherein said water to air heat exchanger is substantially free of coupling to an interior space, wherein said system further comprises a second refrigerant circuit, comprising:

a) a third control means coupled to:
i. a third refrigerant to air heat exchanger;
ii. a second compressor means;
iii. a second refrigerant to water heat exchanger;
iv. a third air circulating means communicating with said third refrigerant to air heat exchanger;

wherein said second refrigerant to water heat exchanger is coupled to said water circuit, and wherein said third control means is further coupled to said water circulating means.

7. The heat transfer system of claim 6, wherein said first control means is further coupled to said water circulating means, wherein said second control means is coupled to said water circulating means, and to said water to air heat exchanger; said second control means overriding said first control means communicating with said water circulating means when the temperature of said water source exceeds a temperature of a comfort zone for swimming in said water source, and wherein said heat transfer system operates in an exterior environment comprising a wet bulb temperature (Twb) of ≧69° F. and a dry bulb temperature (Tdb)≧10° F. greater than said Twb.

8. The heat transfer system of claim 6, wherein said second control means operates said plurality of valves to regulate the temperature of the water source Tws.

9. The heat transfer system of claim 7, further comprising a first supply air duct system coupled to said first refrigerant circuit via said first refrigerant to air heat exchanger and a second supply air duct system coupled to said second refrigerant circuit via said third refrigerant to air heat exchanger.

10. A heat transfer system comprising:

a) a first air conditioning system, comprising:
i) a first refrigerant compressor, a first water condenser, a first evaporator and a first evaporator fan;
ii) a first air condenser and first air condenser fan;
iii) each of said first refrigerant compressor, first water condenser, first evaporator and first air condenser in fluid communication via a first refrigerant circuit;

b) a water circuit comprising at least one water source, said first water condenser, a plurality of valves each communicating via a water conduit and further comprising at least one water circulating means and at least one spray means;

said first air conditioning system further comprising a first control means coupled to said first refrigerant compressor, said first evaporator fan, said first air condenser fan and at least a first of said plurality of said valves spaced between said first water condenser and said at least one water circulating means;

said water circuit further comprising a second control means coupled to said water circulating means and at least a second of said plurality of said valves spaced between said at least one water source and said at least one spray means;

said at least one spray means substantially free of communication with an interior space, the system further comprising;

a second air conditioning system, comprising a second refrigerant compressor, a second water condenser, a second evaporator and second evaporator fan;

each said second refrigerant compressor, second evaporator and said second water condenser communicating via a second refrigerant circuit;

said second air conditioning system further comprising a third control means communicating with said second compressor, said second evaporator fan, said at least one water circulating means and at least a third of said plurality of valves spaced between said second water condenser and said at least one water source;

said water circuit in further communication with said first water condenser, said second water condenser, and said water circuit further comprising a fourth of said plurality of valves, said fourth valve spaced between said at least one spray means and said at least one water source and said at least one water circulation means.

11. The heat transfer system of claim 10, further comprising:

a first air circuit in a first interior space, comprising:

at least one first supply air duct, at least one first return air duct, each communicating via the first air circuit; said first air circuit further communicating with said first evaporator and said first evaporator fan;

a second air circuit in a second interior space comprising:

at least one second supply air duct, at least one second return air duct, each communicating via the second air circuit; said second air circuit further communicating with said second evaporator and said second evaporator fan.

12. The heat transfer system of claim 11 wherein said first air condenser, said first air condenser fan, said at least one water source, and said at least one spray means, are in an ambient environment outside said first or said second interior spaces, said ambient environment comprising a wet bulb temperature (Twb)≧65° F., and a dry bulb temperature (Tdb)≧10° F. greater than said Twb.

13. The heat transfer system of claim 10 or 11 wherein:

when said at least one water source temperature, Tws, is below an effective swimming temperature, said first water condenser and said second water condenser communicate with said water source and said at least one water circulating means;

when Tws is in a temperature effective for swimming, said first water condenser and said second water condenser communicate with said at least one water source, said at least one spray means and said at least one water circulating means communicate with said at least one water source;

when Tws is above an effective temperature for swimming, said first water condenser is free of communication with said at least one water source, said second water condenser, said at least one water circulating means and said at least one spray means are in communication with said at least one water source.

14. The heat transfer system of claim 10 or claim 12 further comprising a third air conditioning system, comprising:

a third refrigerant compressor, a third water condenser, a third evaporator and a third evaporator fan, optionally a second air condenser and optional second air condenser fan;

each said third refrigerant compressor, third water condenser, third evaporator, optional second air condenser and optional second air condenser in communication via a third refrigerant circuit;

the heat transfer system further comprises a third air circuit in a third interior space, comprising:

at least one third supply air duct, at least one third return air duct, each communicating via the third air circuit; said third air circuit further communicating with said third evaporator and third evaporator fan;

said third water condenser communicating with said at least one water source and said at least one water circulation means via said water circuit, a fifth of said plurality of valves spaced between said at least one water source and said third water condenser.

* * * * *